US012324459B2

(12) United States Patent
Biel et al.

(10) Patent No.: US 12,324,459 B2
(45) Date of Patent: Jun. 10, 2025

(54) ELECTRONIC SMOKING DEVICE WITH CAPILLARY ELEMENT

(71) Applicant: Fontem Ventures B.V., Amsterdam (NL)

(72) Inventors: Stefan Biel, Hamburg (DE); Simon James Smith, Cambridge (GB)

(73) Assignee: Fontem Ventures B.V., Amsterdam (NL)

( * ) Notice: Subject to any disclaimer, the term of this patent is extended or adjusted under 35 U.S.C. 154(b) by 0 days.

(21) Appl. No.: 18/504,764

(22) Filed: Nov. 8, 2023

(65) Prior Publication Data

US 2024/0298704 A1 Sep. 12, 2024

Related U.S. Application Data

(63) Continuation of application No. 16/978,886, filed as application No. PCT/EP2019/055419 on Mar. 5, 2019, now Pat. No. 11,844,375.

(30) Foreign Application Priority Data

Mar. 9, 2018 (EP) ..... 18160870

(51) Int. Cl.

| | |
|---|---|
| ***A24F 40/44*** | (2020.01) |
| ***A24F 40/10*** | (2020.01) |
| ***A24F 40/42*** | (2020.01) |
| ***A24F 40/46*** | (2020.01) |

(52) U.S. Cl.

CPC ..... *A24F 40/44* (2020.01); *A24F 40/42* (2020.01); *A24F 40/46* (2020.01); *A24F 40/10* (2020.01)

(58) Field of Classification Search

CPC ..... A24F 40/44; A24F 40/42; A24F 40/46; A24F 40/10

See application file for complete search history.

(56) References Cited

FOREIGN PATENT DOCUMENTS

| | | | | |
|---|---|---|---|---|
| AU | 2013222239 A1 * | 9/2014 | ..... | A24F 40/10 |
| CA | 2863189 A1 * | 8/2013 | ..... | A24B 15/167 |
| JP | 2009168326 A * | 7/2009 | ..... | F28D 15/046 |
| WO | WO-2016059003 A2 * | 4/2016 | ..... | A24F 40/42 |

* cited by examiner

*Primary Examiner* — Jean F Duverne

(74) *Attorney, Agent, or Firm* — Dykema Gossett PLLC

(57) ABSTRACT

An atomizer/liquid portion for an electronic smoking device (10) is described and electronic smoking devices.

Of the atomizer/liquid reservoir portion (14) and the electronic smoking devices, each has a liquid reservoir (34) for storing a liquid, and an atomizer (26) comprising a capillary element (30) and a heating coil (28). The capillary element (30) is configured to capillary draw the liquid from the liquid reservoir (34) towards the heating coil (28). The capillary element (30) comprises different metal meshes (310, 320, 330, 340) differing in capillarity. The different capillary actions result in an overall capillary action which is directed from the ends of the capillary element (30) towards a central portion of the capillary element (30).

5 Claims, 3 Drawing Sheets

ELECTRONIC SMOKING DEVICE WITH CAPILLARY ELEMENT

CROSS-REFERENCE TO RELATED APPLICATIONS

This application is a continuation of U.S. application Ser. No. 16/978,886, filed 8 Sep. 2020 (the '886 application), now U.S. Pat. No. 11,844,375, which is a National Stage Entry of International application no. PCT/EP2019/055419, filed 5 Mar. 2019 (the '419 application), and published under International publication no. WO 2019/170658 on 12 Sep. 2019, which claims priority to European application no. 18160870.4, filed 9 Mar. 2018 (the '870 application). The '886 application, the '419 application, and the '870 application are all hereby incorporated by reference in their entirety as though fully set forth herein.

FIELD OF INVENTION

The present invention relates generally to electronic smoking devices and in particular electronic cigarettes.

BACKGROUND OF THE INVENTION

An electronic smoking device, such as an electronic cigarette (e-cigarette), typically has a housing accommodating an electric power source (e.g. a single use or rechargeable battery, electrical plug, or other power source), and an electrically operable atomizer. The atomizer vaporizes or atomizes liquid supplied from a reservoir and provides vaporized or atomized liquid as an aerosol. Control electronics control the activation of the atomizer. In some electronic cigarettes, an airflow sensor is provided within the electronic smoking device, which detects a user puffing on the device (e.g., by sensing an under-pressure or an air flow pattern through the device). The airflow sensor indicates or signals the puff to the control electronics to power up the device and generate vapor. In other e-cigarettes, a switch is used to power up the e-cigarette to generate a puff of vapor.

Liquid is supplied from the reservoir to the atomizer by means of a capillary element in which the liquid is transported trough capillary action wherein strength of the capillary action is determined by the capillarity of the capillary element.

SUMMARY OF THE INVENTION

In accordance with one aspect of the present invention there is provided an electronic smoking device comprising a power supply portion comprising a power supply, a liquid reservoir, and an atomizer comprising a capillary element and a heating coil. The atomizer is operable to atomize liquid stored in the liquid reservoir when connected to the power supply. The capillary element is configured to draw liquid from the liquid reservoir towards the heating coil by capillary action. The capillary element comprises different metal meshes differing in capillarity.

In accordance with one further aspect of the present invention there is provided an atomizer/liquid reservoir portion. The atomizer/liquid reservoir portion has a liquid reservoir for storing a liquid, and an atomizer comprising a capillary element and a heating coil. The capillary element is configured to capillary draw the liquid from the liquid reservoir towards the heating coil. The capillary element comprises different metal meshes differing in capillarity.

In accordance with one yet further aspect of the present invention there is provided an electronic smoking device comprising said atomizer/liquid reservoir portion.

The characteristics, features and advantages of this invention and the manner in which they are obtained as described above, will become more apparent and be more clearly understood in connection with the following description of exemplary embodiments, which are explained with reference to the accompanying drawings.

BRIEF DESCRIPTION OF THE DRAWINGS

In the drawings, same element numbers indicate same elements in each of the views.

DESCRIPTION OF THE PREFERRED EMBODIMENTS

Figure 1:
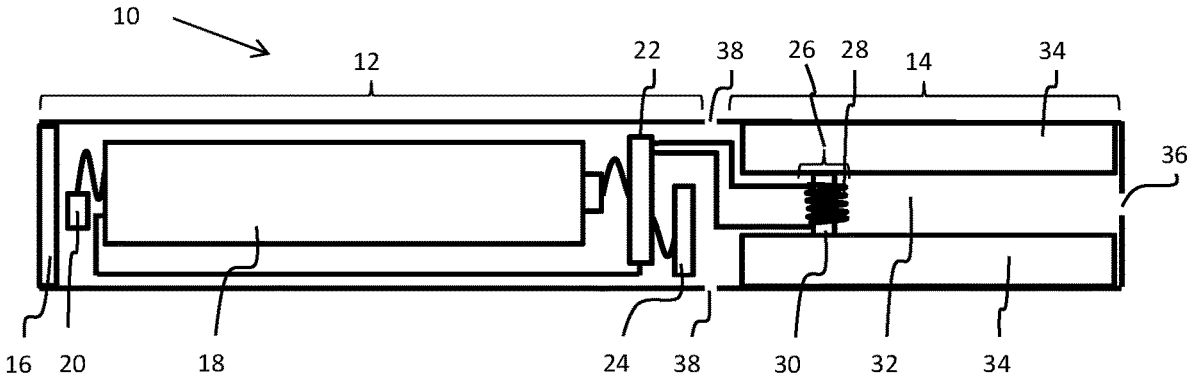
FIG. 1 is a schematic cross-sectional illustration of an exemplary e-cigarette.

Throughout the following, an electronic smoking device will be exemplarily described with reference to an e-cigarette. As is shown in FIG. 1, an e-cigarette 10 typically has a housing comprising a cylindrical hollow tube having an end cap 16. The cylindrical hollow tube may be a single-piece or a multiple-piece tube. In FIG. 1, the cylindrical hollow tube is shown as a two-piece structure having a power supply portion 12 and an atomizer/liquid reservoir portion 14.

Together the power supply portion 12 and the atomizer/liquid reservoir portion 14 form a cylindrical tube which can be approximately the same size and shape as a conventional cigarette, typically about 100 mm with a 7.5 mm diameter, although lengths may range from 70 to 150 or 180 mm, and diameters from 5 to 28 mm.

The power supply portion 12 and atomizer/liquid reservoir portion 14 are typically made of metal, e.g. steel or aluminium, or of hardwearing plastic and act together with the end cap 16 to provide a housing to contain the components of the e-cigarette 10. The power supply portion 12 and an atomizer/liquid reservoir portion 14 may be configured to fit together by a friction push fit, a snap fit, or a bayonet attachment, magnetic fit, or screw threads. The end cap 16 is provided at the front end of the power supply portion 12. The end cap 16 may be made from translucent plastic or other translucent material to allow a light-emitting diode (LED) 20 positioned near the end cap to emit light through the end cap. The end cap can be made of metal or other materials that do not allow light to pass.

An air inlet may be provided in the end cap, at the edge of the inlet next to the cylindrical hollow tube, anywhere along the length of the cylindrical hollow tube, or at the connection of the power supply portion 12 and the atomizer/liquid reservoir portion 14. FIG. 1 shows a pair of air inlets 38 provided at the intersection between the power supply portion 12 and the atomizer/liquid reservoir portion 14.

A power supply, preferably a battery 18, an LED 20, control electronics 22 and optionally an airflow sensor 24 are provided within the cylindrical hollow tube power supply portion 12. The battery 18 is electrically connected to the control electronics 22, which are electrically connected to the LED 20 and the airflow sensor 24. In this example, the LED 20 is at the front end of the power supply portion 12, adjacent to the end cap 16 and the control electronics 22 and airflow sensor 24 are provided in the central cavity at the other end of the battery 18 adjacent to the atomizer/liquid reservoir portion 14.

The airflow sensor 24 acts as a puff detector, detecting a user puffing or sucking on the atomizer/liquid reservoir portion 14 of the e-cigarette 10. The airflow sensor 24 can be any suitable sensor for detecting changes in airflow or air pressure, such as a microphone switch including a deformable membrane which is caused to move by variations in air pressure. Alternatively, the sensor may be a Hall element or an electro-mechanical sensor.

The control electronics 22 are also connected to an atomizer 26. In the example shown, the atomizer 26 includes a heating coil 28 which is wrapped around a capillary element 30 extending across a central passage 32 of the atomizer/liquid reservoir portion 14. The coil 28 may be positioned anywhere in the atomizer 26 and may be transverse or parallel to the liquid reservoir 34. The capillary element 30 and heating coil 28 do not completely block the central passage 32. Rather an air gap is provided on either side of the heating coil 28 enabling air to flow past the heating coil 28 and the capillary element 30. The atomizer may alternatively use other forms of heating elements, such as ceramic heaters, or fiber or mesh material heaters. Non-resistance heating elements such as sonic, piezo and jet spray may also be used in the atomizer in place of the heating coil.

The central passage 32 is surrounded by a cylindrical liquid reservoir 34 with the ends of the capillary element 30 abutting or extending into the liquid reservoir 34.

According to an exemplary embodiment, the capillary element 30, also called wick, comprises different metal meshes differing in capillarity, with higher capillarity resulting in higher capillary action, with liquid from the liquid reservoir 34 being drawn by overall capillary action of the capillary element from the ends of the capillary element 30 towards the central portion of the capillary element 30 encircled by the heating coil 28. The use of metal meshes makes the capillary element 30 particularly stable against aging.

The liquid reservoir 34 may alternatively include wadding soaked in liquid which encircles the central passage 32 with the ends of the capillary element 30 abutting the wadding. In other embodiments, the liquid reservoir 34 may comprise a toroidal cavity arranged to be filled with liquid and with the ends of the capillary element 30 extending into the toroidal cavity.

An air inhalation port 36 is provided at the back end of the atomizer/liquid reservoir portion 14 remote from the end cap 16. The inhalation port 36 may be formed from the cylindrical hollow tube atomizer/liquid reservoir portion 14 or maybe formed in an end cap.

In use, a user sucks on the e-cigarette 10. This causes air to be drawn into the e-cigarette 10 via one or more air inlets, such as air inlets 38, and to be drawn through the central passage 32 towards the air inhalation port 36. The change in air pressure which arises is detected by the airflow sensor 24, which generates an electrical signal that is passed to the control electronics 22. In response to the signal, the control electronics 22 activate the heating coil 28, which causes liquid present in the capillary element 30 to be vaporized creating an aerosol (which may comprise gaseous and liquid components) within the central passage 32. As the user continues to suck on the e-cigarette 10, this aerosol is drawn through the central passage 32 and inhaled by the user. At the same time, the control electronics 22 also activate the LED 20 causing the LED 20 to light up which is visible via the translucent end cap 16 mimicking the appearance of a glowing ember at the end of a conventional cigarette. As liquid present in the capillary element 30 is converted into an aerosol, more liquid is drawn into the capillary element 30 from the liquid reservoir 34 by the overall capillary action and thus is available to be converted into an aerosol through subsequent activation of the heating coil 28.

Some e-cigarettes are intended to be disposable and the electric power in the battery 18 is intended to be sufficient to vaporize the liquid contained within the liquid reservoir 34, after which the e-cigarette 10 is thrown away. In other embodiments the battery 18 is rechargeable and the liquid reservoir 34 is refillable. In the cases where the liquid reservoir 34 is a toroidal cavity, this may be achieved by refilling the liquid reservoir 34 via a refill port. In other embodiments the atomizer/liquid reservoir portion 14 of the e-cigarette 10 is detachable from the power supply portion 12 and a new atomizer/liquid reservoir portion 14 can be fitted with a new liquid reservoir 34 thereby replenishing the supply of liquid. In some cases, replacing the liquid reservoir 34 may involve replacement of the heating coil 28 and the capillary element 30 along with the replacement of the liquid reservoir 34. A replaceable unit comprising the atomizer 26 and the liquid reservoir 34 is called a cartomizer.

The new liquid reservoir 34 may be in the form of a cartridge having a central passage 32 through which a user inhales aerosol. In other embodiments, aerosol may flow around the exterior of the cartridge to an air inhalation port 36.

Of course, in addition to the above description of the structure and function of a typical e-cigarette 10, variations also exist. For example, the LED 20 may be omitted. The airflow sensor 24 may be placed adjacent the end cap 16 rather than in the middle of the e-cigarette. The airflow sensor 24 may be replaced with a switch which enables a user to activate the e-cigarette manually rather than in response to the detection of a change in air flow or air pressure.

Different types of atomizers may be used. Thus, for example, the atomizer may have a heating coil in a cavity in the interior of a stack of metal meshes soaked in liquid. In this design aerosol is generated by evaporating the liquid within the stack of metal meshes either by activation of the coil heating the stack of metal meshes or alternatively by the heated air passing over or through the stack of metal meshes. Alternatively, the atomizer may use a piezoelectric atomizer to create an aerosol either in combination or in the absence of a heater.

Figure 2:
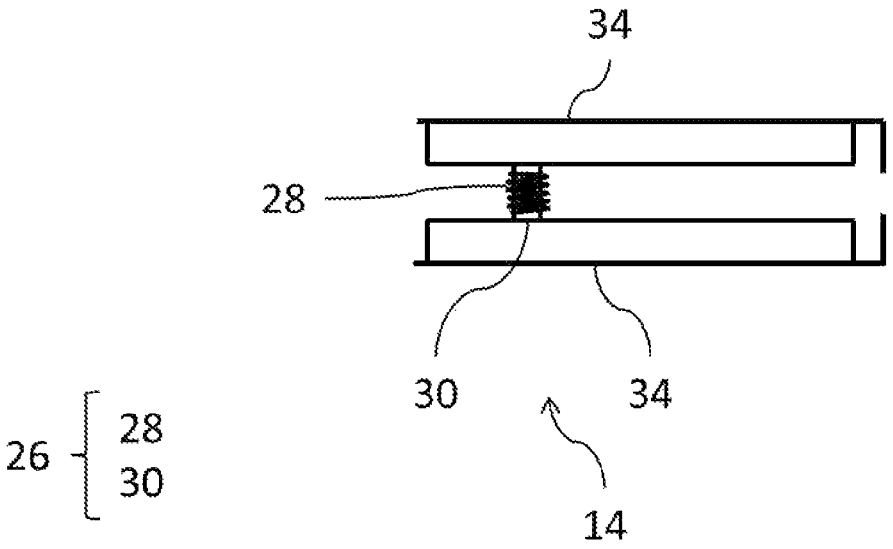
FIG. 2 is a schematic cross-sectional illustration of an exemplary atomizer/liquid reservoir portion.

In an exemplary embodiment shown in FIG. 2, an atomizer/liquid reservoir portion 14 for an electronic smoking device comprises a liquid reservoir 34 for storing a liquid, and an atomizer 26 comprising a capillary element 30 and a heating coil 28. The capillary element 30 is configured to capillary draw the liquid from the liquid reservoir 34 towards the heating coil 28.

Figure 3:
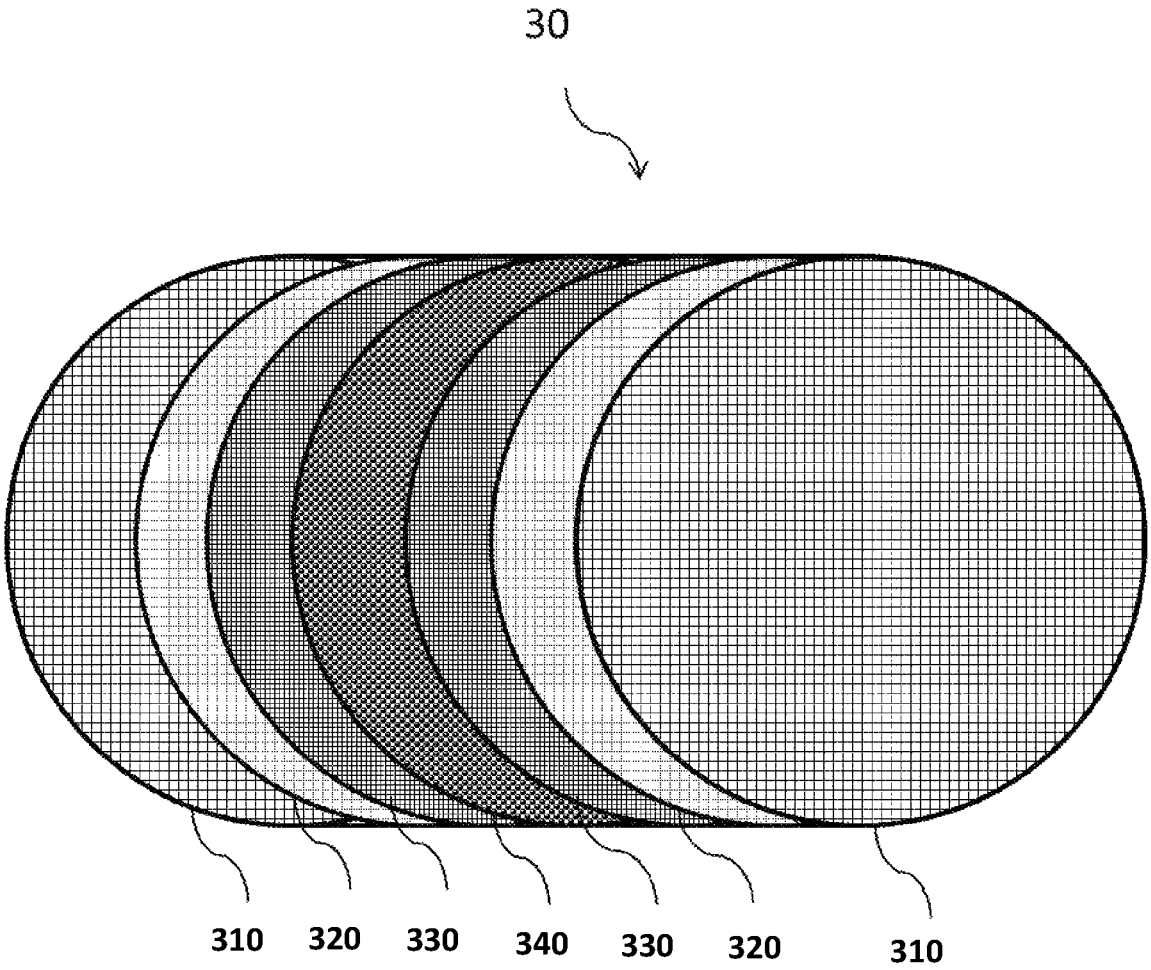
FIG. 3 is a schematic cross-sectional illustration of an exemplary capillary element

According to the invention the at least one capillary element 30 comprises different metal meshes differing in capillarity, i.e. comprises a series of metal meshes. For instance, different metal meshes 310, 320, 330, 340 are stacked inside the capillary element 30 as exemplarily shown in FIG. 3. Meshes 310 with a lowest capillarity are arranged the respective ends of the capillary element enclosing meshes 320 with a higher capillarity which enclose meshes 330 with an even higher capillarity. Aligned with the central portion of the capillary element 30 and surrounded by the meshes 330, there is a mesh 340 having the highest capillarity. This arrangement forces liquid from the liquid reservoir 34 to go in direction of the central portion of the capillary element 30 at a desired liquid transfer speed and prevents liquid in the capillary element 30 from flowing back into the liquid reservoir 34 thereby enabling controlled liquid flow and better emptying of the liquid reservoir 34.

For instance, meshes with largest mesh sizes and/or thickest filaments are arranged at the ends of the capillary element 30 enclosing meshes with smaller mesh sizes and/or finer filaments which enclose meshes with even smaller mesh sizes and/or even finer filaments. Aligned with the central portion of the capillary element 30 and surrounded by the meshes, there is a mesh having the smallest mesh size and/or the finest filaments.

In another exemplary embodiment, the capillary element will contact a liquid reservoir only on one end, a first end, where the other end, a second end is not in contact with the liquid reservoir. Again, different metal meshes are stacked in series to form the capillary element. However, now the capillarity of the meshes increases continuously from the first end of the capillary element towards the second end. I.e. a mesh with lowest capillarity is arranged at said first end and a mesh with highest capillarity is arranged at said second end. Said first end is configured to be abutted into the reservoir. This arrangement forces liquid from the liquid reservoir to go in direction of the second end of the capillary element at a desired liquid transfer speed and prevents liquid in the capillary element from flowing back into the liquid reservoir thereby enabling controlled liquid flow and better emptying of the liquid reservoir. At the second end of the capillary element a heating element can be arranged, for instance.

Another way to influence the capillary action of the meshes could entail different coatings on a mesh which may enhance or reduce the wicking properties.

In an exemplary embodiment, an electronic smoking device comprises a power supply portion comprising a power supply, and the atomizer/liquid reservoir portion according to the exemplary embodiment. The atomizer of the atomizer/liquid reservoir portion is operable when connected to the power supply to atomize liquid stored in the liquid reservoir.

In another exemplary embodiment, an electronic smoking device comprises a power supply portion comprising a power supply, a liquid reservoir, and an atomizer comprising a capillary element and a heating coil. The atomizer is operable when connected to the power supply to atomize liquid stored in the liquid reservoir. The capillary element is configured to draw liquid from the liquid reservoir towards the heating coil by capillary action. The capillary element comprises different metal meshes differing in capillarity.

In the exemplary atomizer/liquid reservoir portion and/or in one or both of the exemplary electronic smoking devices, the heating coil can be wrapped around the capillary element, but that is optional. The capillary element can optionally extend across a central passage of the atomizer/liquid reservoir portion such that an air gap is provided on either side of the heating coil enabling air to flow past the heating coil and the capillary element. Facultative, the liquid reservoir can be cylindrical, for instance, surrounding the central passage. Ends of the capillary element can be configured to abut or extend into the liquid reservoir. Different capillary element configurations are possible. The different capillary actions can result in an overall capillary action which is directed from the ends of the capillary element towards a central portion of the capillary element. The metal meshes can differ in mesh size and/or filament thickness, for instance. The metal meshes can be staked or arranged differently.

While this invention has been described in connection with what is presently considered to be practical exemplary embodiments, it is to be understood that the invention is not limited to the disclosed embodiments, but, on the contrary, is intended to cover various modifications and equivalent arrangements included within the scope of the appended claims.

LIST OF REFERENCE SIGNS

10 electronic smoking device
12 power supply portion
14 atomizer/liquid reservoir portion
16 end cap
18 battery
20 light-emitting diode (LED)
22 control electronics
24 airflow sensor
26 atomizer
28 heating coil
30 capillary element
32 central passage
34 liquid reservoir
36 air inhalation port
38 air inlets
310, 320, 330, 340 metal meshes differing in capillarity

The invention claimed is:

1. A capillary element for an electronic smoking device comprising:

outer metal meshes having capillarity; and inner metal meshes having a higher capillarity than the outer metal meshes, wherein the inner metal meshes are enclosed by the outer metal meshes, wherein the inner and outer metal meshes are configured and arranged to draw liquid towards a heating coil by capillary action, and wherein different capillary actions result in an overall capillary action which is directed from the outer metal meshes towards the inner metal meshes.

2. The capillary element of claim 1, further comprising:

a center metal mesh having a higher capillarity than the inner metal meshes and located between the inner metal meshes.

3. The capillary element of claim 1, wherein the outer metal meshes abut or extend into a liquid reservoir.

4. The capillary element of claim 1, wherein the inner and outer metal meshes differ in mesh size and/or filament thickness.

5. The capillary element of claim 1, wherein the inner and outer metal meshes are staked.

* * * * *